US007413036B2

(12) United States Patent
Law et al.

(10) Patent No.: US 7,413,036 B2
(45) Date of Patent: Aug. 19, 2008

(54) SUB DRILLING SUB

(75) Inventors: Arnold R. Law, Garland, TX (US); Ajay Kumar, Garland, TX (US)

(73) Assignee: Atlas Copco Drilling Solutions Inc., Garland, TX (US)

( * ) Notice: Subject to any disclaimer, the term of this patent is extended or adjusted under 35 U.S.C. 154(b) by 0 days.

(21) Appl. No.: 10/591,549

(22) PCT Filed: Mar. 4, 2004

(86) PCT No.: PCT/US2004/006674

§ 371 (c)(1),
(2), (4) Date: Jul. 12, 2007

(87) PCT Pub. No.: WO2005/095754

PCT Pub. Date: Oct. 13, 2005

(65) Prior Publication Data

US 2008/0017420 A1 Jan. 24, 2008

(51) Int. Cl.
*E21B 17/07* (2006.01)

(52) U.S. Cl. ..... 175/321; 166/242.7

(58) Field of Classification Search ..... 175/321, 175/322, 57, 320; 166/242.7, 242.1
See application file for complete search history.

(56) References Cited

U.S. PATENT DOCUMENTS 3,194,330 A * 7/1965 Ware et al. ..... 175/321
3,447,652 A * 6/1969 Tipton ..... 192/85 AT
3,763,666 A 10/1973 Tibussek
4,196,781 A * 4/1980 Cheek ..... 175/61
5,168,944 A * 12/1992 Andersson ..... 175/321
6,332,841 B1 12/2001 Secord

FOREIGN PATENT DOCUMENTS

EP 0 376 239 7/1990
EP 376239 A * 7/1990

OTHER PUBLICATIONS

Model 306430 Floating Cushion Sub, Formost Industries Inc., 2 pages, available before Jan. 23, 2003.
Thruster Systems Improved Performance-Reduced Vibrations, Baker Hughes Incorporated, 603-019, 4 pages, Jul. 1999.

* cited by examiner

*Primary Examiner*—Jennifer H Gay
*Assistant Examiner*—Daniel P Stephenson
(74) *Attorney, Agent, or Firm*—Michael Best & Friedrich

(57) ABSTRACT

A telescoping sub (50) for mining operations and the like. The telescoping sub (50) includes a rotor (94) portion coupleadle to the rotary head of a drilling rig, and a stator (74) portion that is coupleable to a drill rod. The rotor (94) portion is slideadly coupled to the stator (74) portion and is moveable with respect thereto between an extended position and a retracted position. With the telescoping sub (50) in the retracted position, the drilling rig is operated to drill to a first depth. The drilling rig is then operated to move the rotor (94) portion to the extended position, and the drilling rig is operated to drill to a second depth that is greater than the first depth.

19 Claims, 14 Drawing Sheets

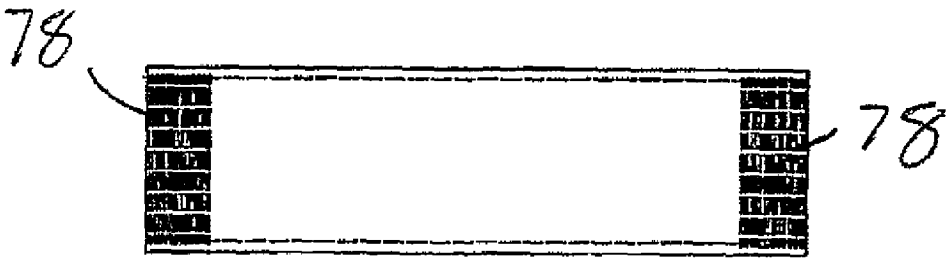
Fig. 5b
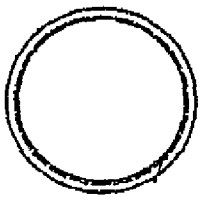
Fig 5c
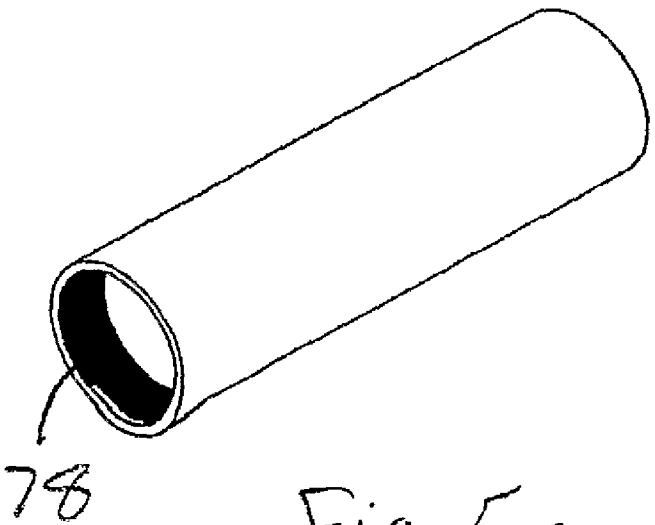
Fig 5a
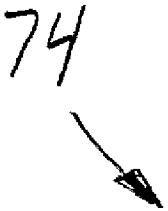

82

130

10
106
98
110
94
130
50
92
166
74
138
142
166
70
54
162
134
158
102

98
106
94
92
82
78
166
138
74
154
166
62
66
54
130
90
86
102
126
154
134
78
58

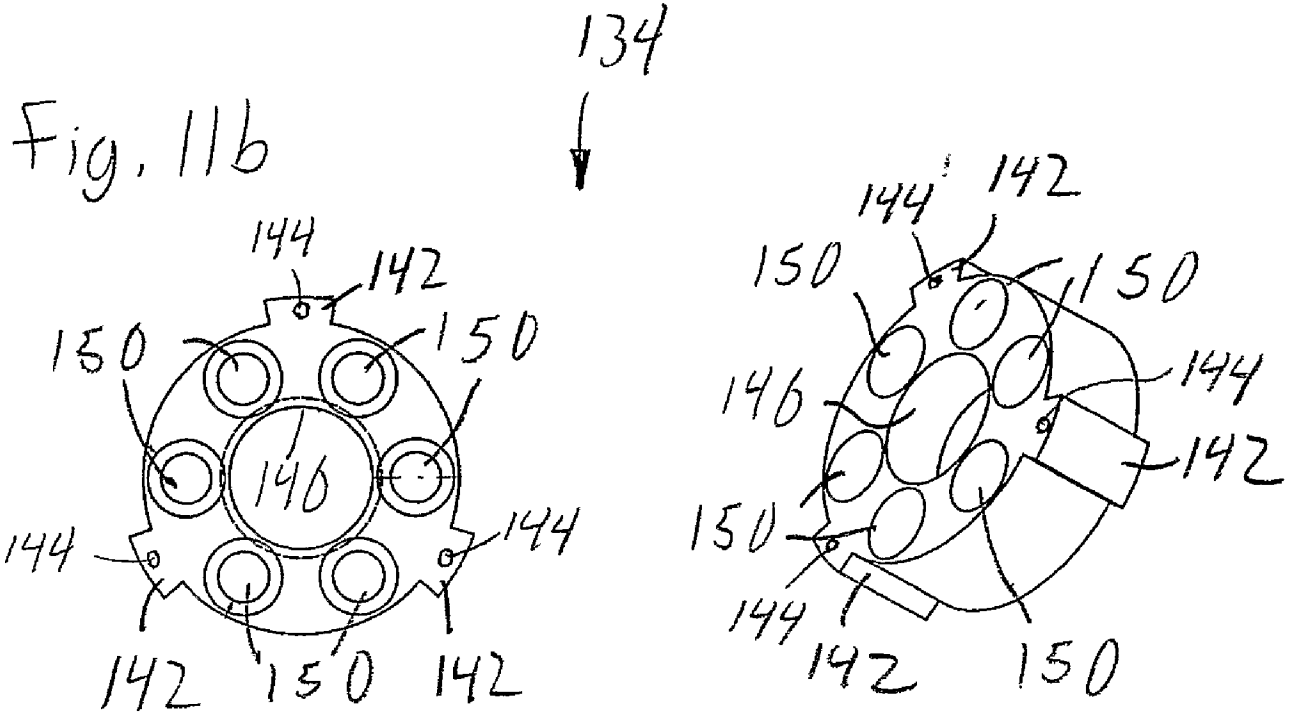
Fig. 11a
Fig. 11b
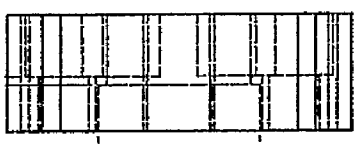
Fig. 11c

138

19
19
74'
74'
134'
186
186
94'
94'
184
184
194
196
50'
50'
196
190
190
188
192
194
192
194
184

SUB DRILLING SUB

FIELD OF THE INVENTION

The invention relates to drilling, and more particularly, to subs for blast hole drilling and other mining operations.

BACKGROUND OF THE INVENTION

Known drilling machines include a frame supported for movement over the ground, and a tower mounted on the frame for movement between a generally horizontal stowed position, and a vertical or angled operating position. A deck is supported by the frame and has a generally horizontal upper surface with an opening through which a drill rod is extendable. A rotary head is movable along the tower and engageable with the drill rod to move the drill rod vertically and to rotate the drill rod.

The rotary head urges the drill rod downwardly to penetrate the ground and to create a drilled hole. Known drilling machines are capable of drilling to depths greater than the height of the tower by connecting multiple drill rods together to create a drill string that is longer than the height of the tower. This is accomplished by drilling a first drill rod into the ground until the rotary head is completely lowered. Next, the rotary head is disconnected from first drill rod and raised to the top of the tower such that a second, upper drill rod can be connected to the rotary head. The second drill rod is then threaded to the first, lower drill rod, and the second drill rod can then be drilled into the ground. Additional drill rods can be added to the drill string in a similar manner until the hole is drilled to the desired depth.

With known drilling methods, the drilling depth that is reachable without requiring the use of multiple drill rods is generally limited by the height of the tower. That is, a single drill rod can only be drilled to a depth corresponding to the distance that is traveled by the rotary head in moving from the top of the tower to the bottom of the tower. If a hole having a depth greater than the travel distance of the rotary head is required, additional drill rods must be utilized. The process of coupling and decoupling multiple drill rods to one another in order to drill to a desired depth adds significant time, cost, and complication to a drilling operation. Furthermore, known methods of coupling and decoupling drill rods, including impact breakout systems and non-impact breakout systems, are often inconsistent and can damage the drill rods and the drilling machine.

SUMMARY OF THE INVENTION

The present invention provides a telescoping sub that is coupleable to a drill rod for mining operations and the like. The telescoping sub includes a rotor portion coupleable to the drilling machine, and a stator portion coupleable to the drill rod. The rotor portion is slideably coupled to the stator portion and is moveable between an extended position and a retracted position to increase the depth to which the hole can be drilled.

In some embodiments, a bottom sub and a seal guide are coupled to a stator housing to define a chamber. A rotor shaft is received by the chamber and a plurality of lock plates are coupled to the stator housing and positioned in an annular space defined between the rotor shaft and the stator housing. A first detent assembly is positioned within the chamber adjacent the bottom sub, and a second detent assembly is positioned within the chamber adjacent the seal guide. A rotor dog is coupled to an end of the rotor shaft and engages the lock plates when the rotor portion is in the extended and retracted positions. The first and second detent assemblies engage the rotor dog in the retracted and extended positions, respectively, and provide detent rotational engagement between the rotor portion and the stator portion.

The present invention also provides a method for drilling a hole in the ground with such a telescoping sub. The drill rod is rotated in a first direction, and urged into the ground to a first depth. Downward movement is stopped, and the rotor portion is rotated in a second direction and moved vertically with respect to the stator portion to the extended position. While in the extended position, the telescoping sub is again rotated in the first direction and urged into the ground to a second depth that is greater than the first depth.

Other features of the invention will become apparent to those skilled in the art upon review of the following detailed description, and drawings.

BRIEF DESCRIPTION OF THE DRAWINGS

FIG. 5*a* is a perspective view illustrating a stator housing of the telescoping sub shown in FIG. 3.

FIG. 5*b* is a side view of the stator housing shown in FIG. 5*a*.

FIG. 5*c* is an end view of the stator housing showin in FIG. 5*a*.

FIG. 11 a is a perspective view illustrating a rotor dog of the telescoping sub shown in FIG. 3.

FIG. 11*b* is a side view of the bushing shown in FIG. 11*a*.

FIG. 11*c* is an end view of the bushing shown in FIG. 11*a*.

Figure 1:
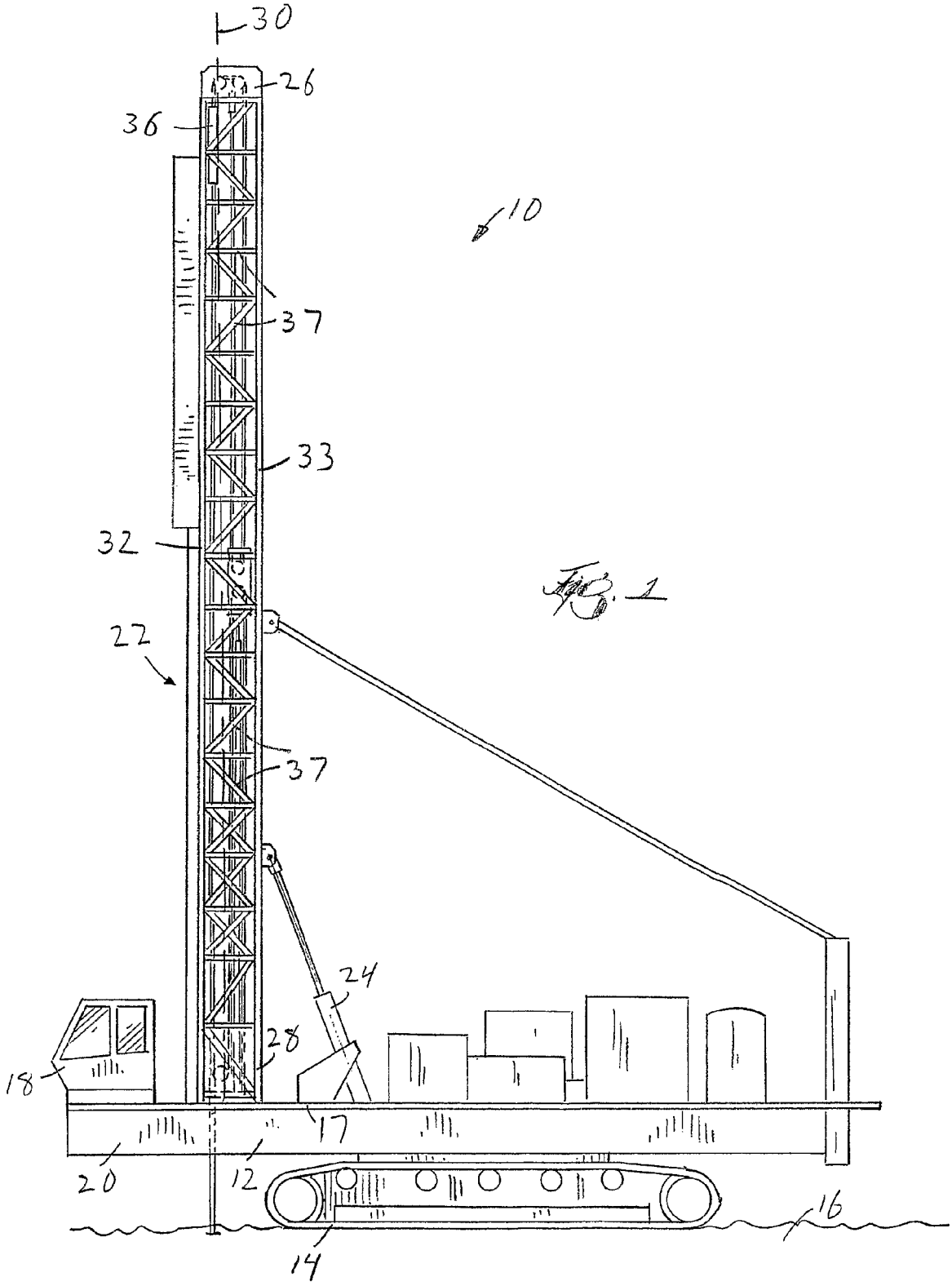
FIG. 1 is a side view of a drilling rig embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION

FIG. 1 illustrates a drilling rig or drilling machine 10 including a frame 12 that is supported by crawlers 14 for movement along the ground 16, and that supports a deck 17 to which various drilling machine components can be mounted. The drilling machine 10 includes an operator station 18 located on the front 20 of the frame 12 and a tower 22 pivotally mounted on the frame 12. The tower 22 is sometimes referred to as a derrick or mast and is movable relative to the frame 12 between a substantially vertical position and a non-vertical position by a tower lift cylinder 24. Varying the position of the tower 22 varies the angle of drilling, as is known in the art. The top 26 of the tower 22 is generally referred to as the crown and the bottom 28 of the tower 22 is generally referred to as the tower base. The tower 22 defines a longitudinal axis 30 and includes two forward elongated members or chords 32, and two rearward chords 33. The chords 32, 33 are connected together and supported by truss members 37 along the tower.

Figure 2:
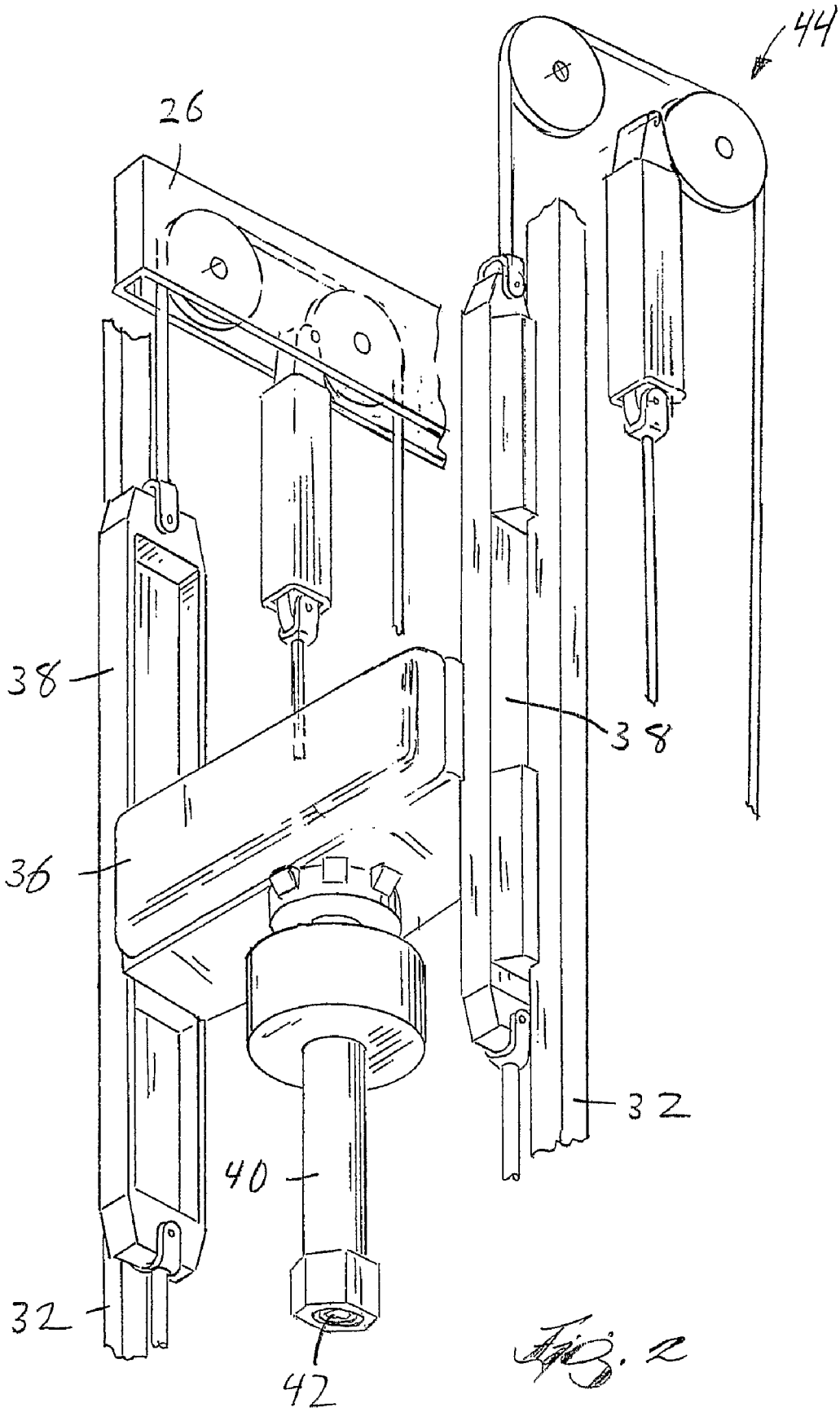
FIG. 2 is an enlarged perspective view illustrating a rotary head guide of the drilling rig shown in FIG. 1.
Figure 3:
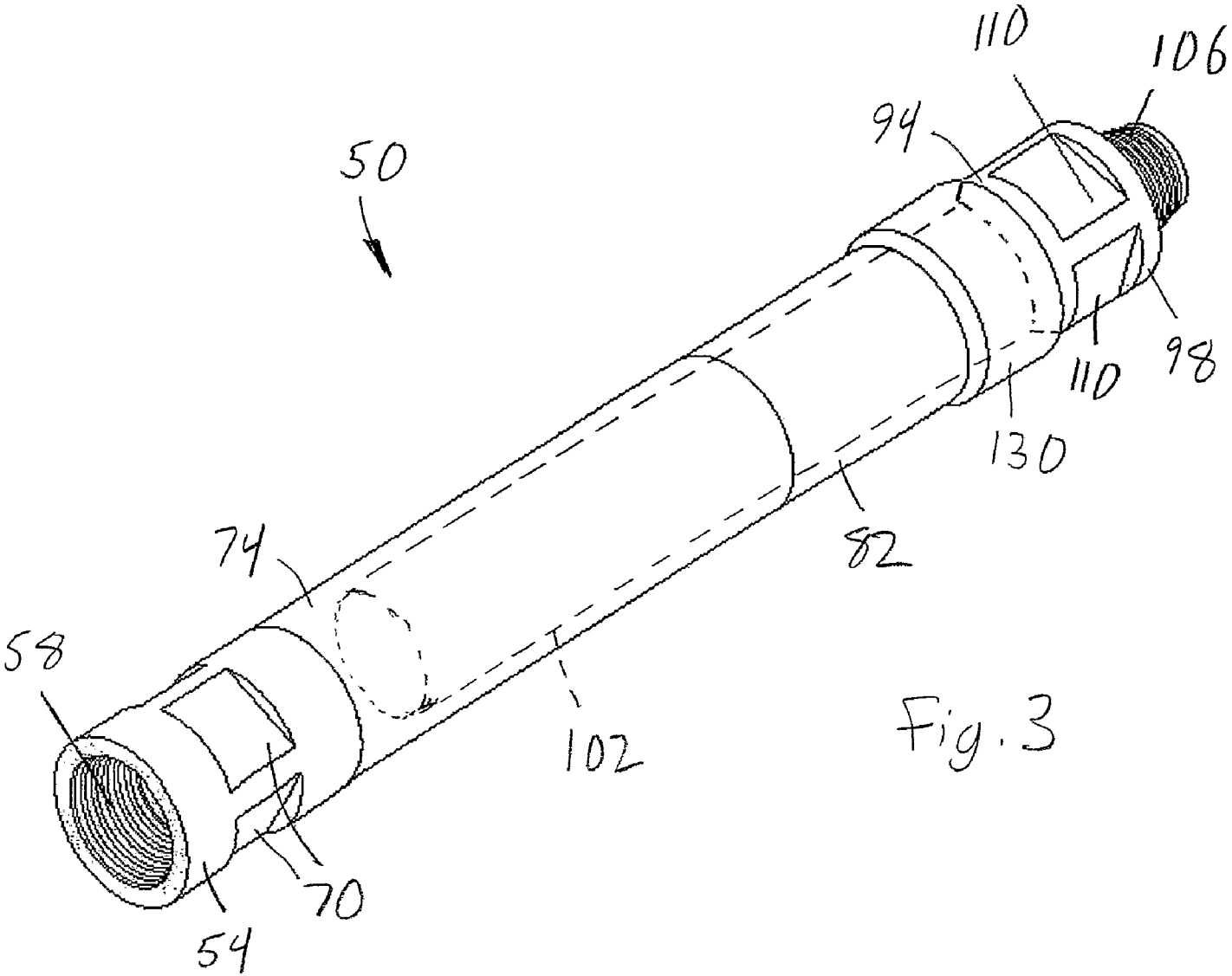
FIG. 3 is a perspective view illustrating a telescoping sub embodying some aspects of the present invention.
Figure 4A:
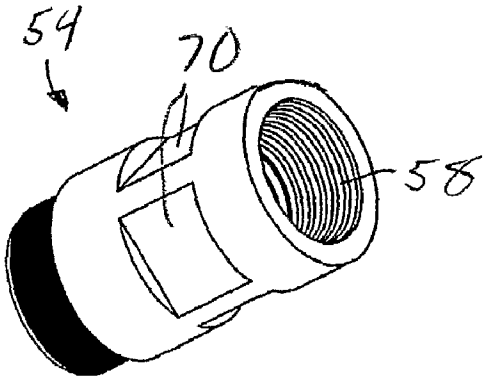
FIG. 4*a* is a perspective view illustrating a bottom sub of the telescoping sub shown in FIG. 3.
Figure 4B:
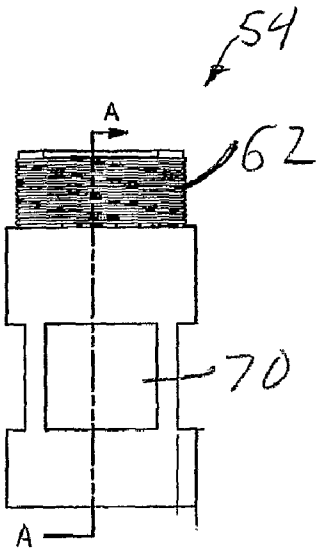
FIG. 4*b* is a side view illustrating the bottom sub shown in FIG. 4*a*.
Figure 4C:
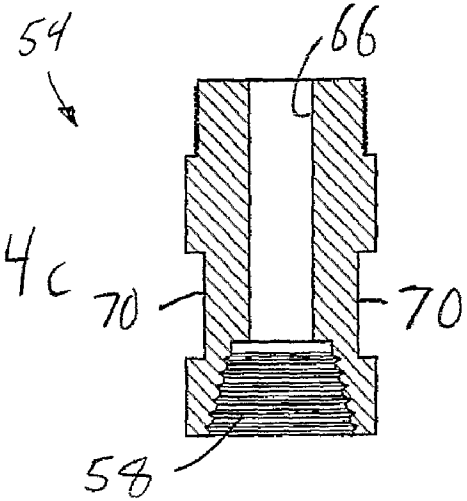
FIG. 4*c* is a section view taken along line A-A of FIG. 4*b*.

Referring also to FIG. 2, the illustrated drilling machine 10 includes a rotary head 36 and rotary head guides 38. The rotary head guides 38 are connected to the rotary head 36 and are slidably coupled to respective chords 32. The rotary head 36 includes a rotatable portion 40 that defines an internally threaded bore 42, and a motor (not shown) for rotating the rotatable portion 40. The motor is reversible such that the rotatable portion 40 can be rotated in both clockwise and counterclockwise directions. A feed cable system 44 is operable to move the rotary head 36 between a raised position, in which the rotary head 36 is at the top 26 of the tower 22, and a lowered position, in which the rotary head 36 is at the bottom 28 of the tower 22.

With reference now to FIGS. 3-8, a sub drilling telescoping sub 50 embodying some aspects of the present invention includes a generally cylindrical bottom sub 54 (FIG. 4) that is coupleable to, among other things a standard drill rod or other subs. One end of the bottom sub 54 defines a tapered, internally threaded bore 58, and the opposite end of the bottom sub 54 defines an externally threaded surface 62. The bottom sub 54 is generally tubular and defines a channel 66 extending from the threaded bore 58 to the opposite end. A series of flats 70 are defined along an outer surface of the bottom sub 54 and are arranged in substantially parallel pairs. The flats 70 are engageable by a clamping mechanism (not shown) on the deck 17 of the drilling machine 10 to substantially rotatably fix the bottom sub 54, for reasons that will become apparent below.

The telescoping sub 50 also includes a generally tubular stator housing 74 (FIG. 5). Each end of the stator housing 74 defines an internally threaded surface 78. At least one of the internally threaded surfaces 78 is configured to threadably engage the externally threaded surface 62 of the bottom sub 54.

Figure 6A:
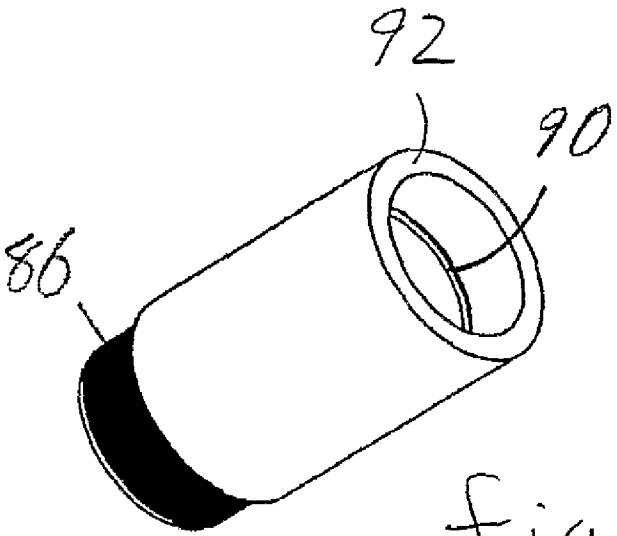
FIG. 6*a* is a perspective view illustrating a seal guide of the telescoping sub shown in FIG. 3.
Figure 6C:
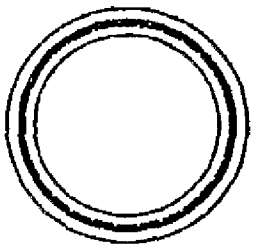
FIG. 6*c* is an end view of the seal guide shown in FIG. 6*a*.
Figure 6B:
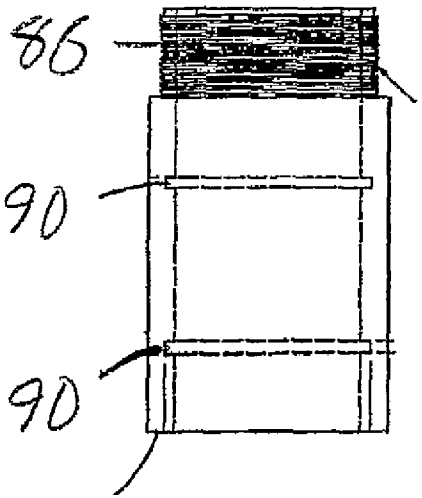
FIG. 6*b* is a side view of the seal guide shown in FIG. 6*a*.
Figures 7A, 7B, 7C:
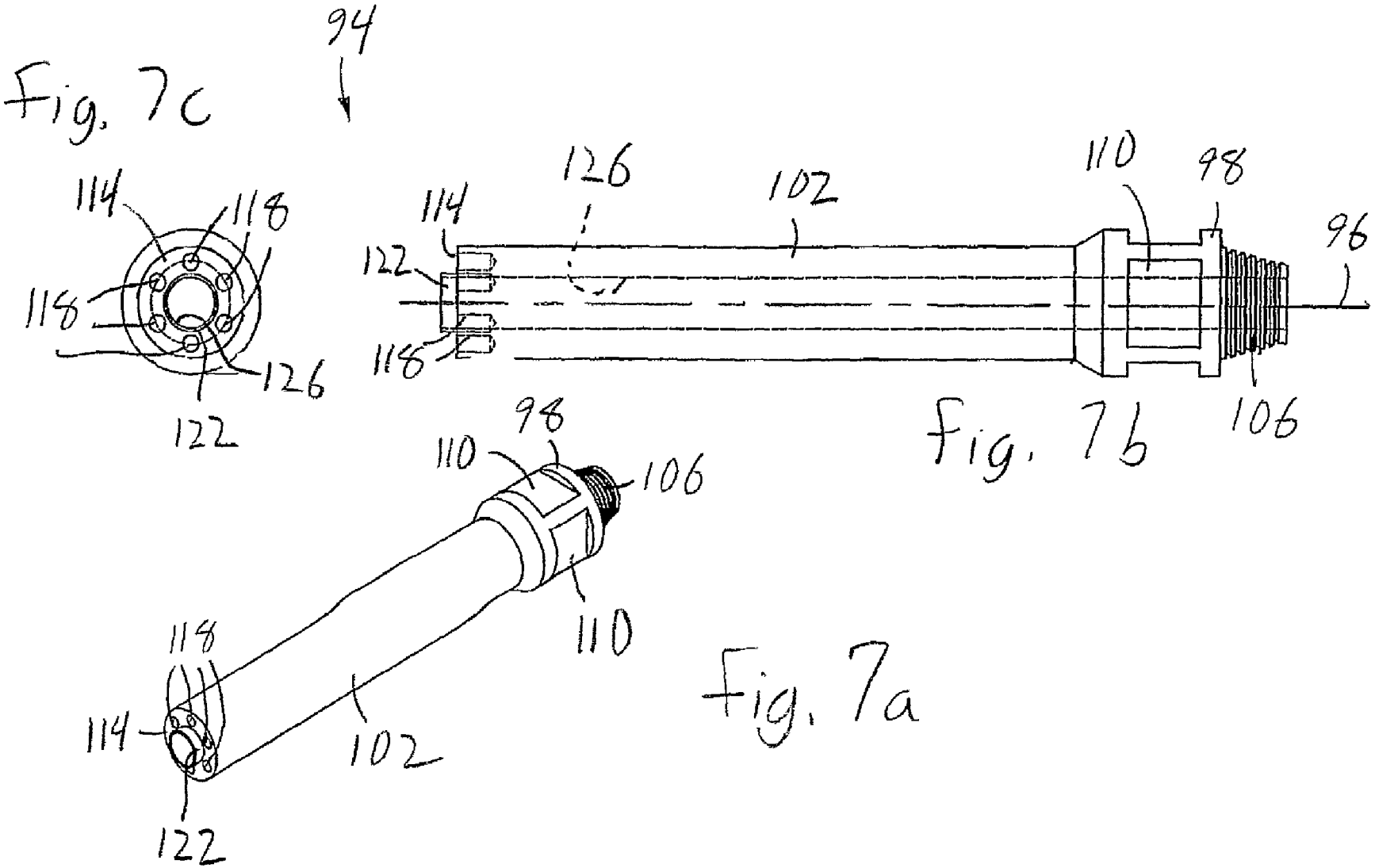
FIG. 7*a* is a perspective view illustrating a rotor shaft of the telescoping sub shown in FIG. 3.
FIG. 7*b* is a side view of the rotor shaft shown in FIG. 7*a*.
FIG. 7*c* is an end view of the rotor shaft shown in FIG. 7*a*.
Figure 8A:
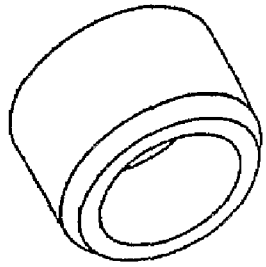
FIG. 8*a* is a perspective view illustrating a bushing of the telescoping sub shown in FIG. 3.
Figure 8B:
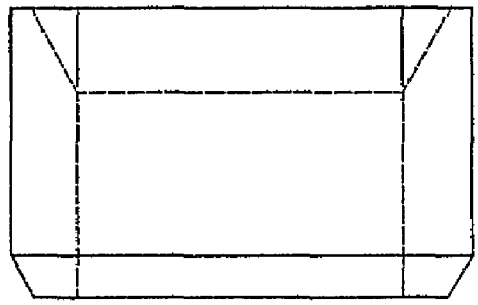
FIG. 8*b* is a side view of the bushing shown in FIG. 8*a*.
Figure 8C:
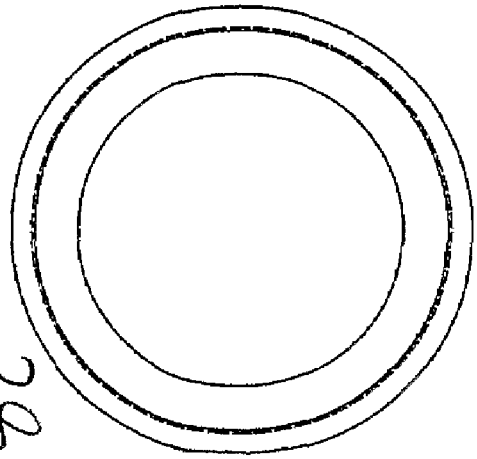
FIG. 8*c* is an end view of the bushing shown in FIG. 8*a*.
Figures 9, 10:
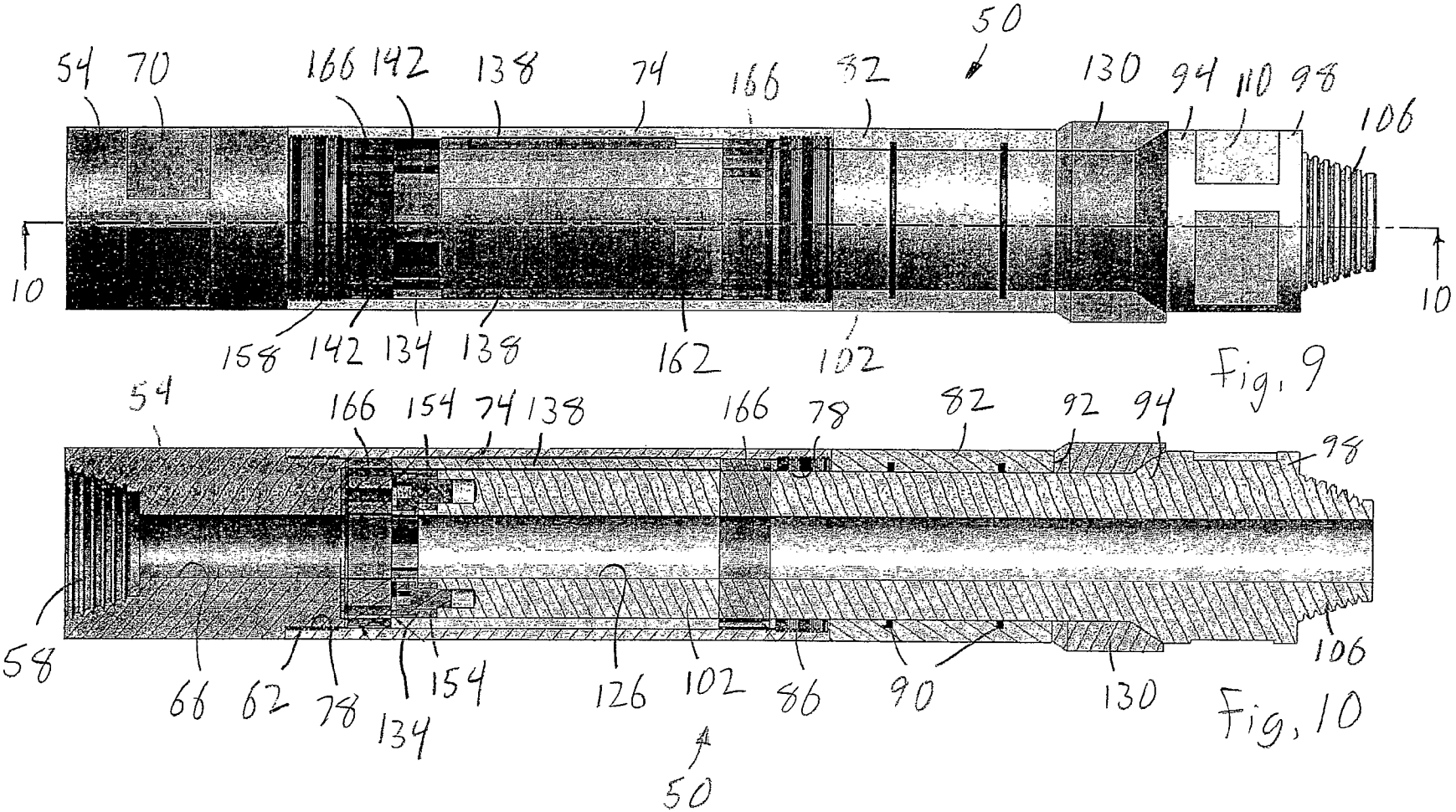
FIG. 9 is a side view of the telescoping sub shown in FIG. 3, with portions in phantom.
FIG. 10 is a section view taken along line 10-10 of FIG. 9.
Figure 12A:
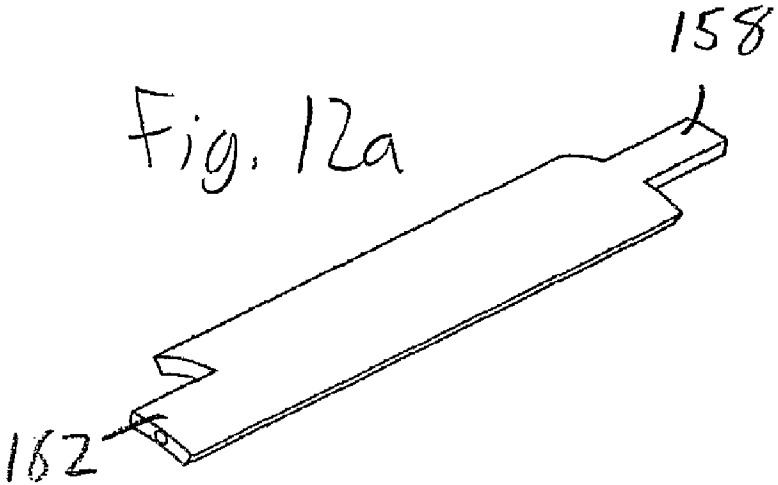
FIG. 12*a* is a perspective view illustrating a lock plate of the telescoping sub shown in FIG. 3.
Figure 12B:
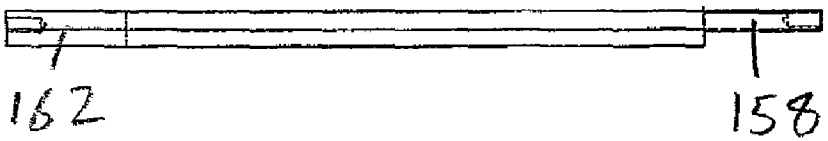
FIG. 12*b* is a side view of the lock plate shown in FIG. 12*a*.
Figure 12C:
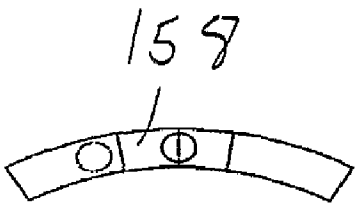
FIG. 12*c* is an end view of the lock plate shown in FIG. 12*a*.
Figure 12D:
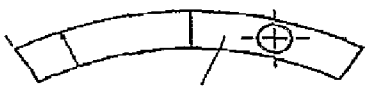
FIG. 12*d* is another end view of the lock plate shown in FIG. 12*a*.

The telescoping sub 50 further includes a generally tubular seal guide 82 (FIG. 6). A pair of circumferential grooves 90 are recessed with respect to an inner surface of the seal guide 82 and receive resilient seals (not shown). One end of the seal guide 82 defines an externally threaded surface 86 that is engageable with the other of the internally threaded surfaces 78 of the stator housing 74, and an opposite end of the seal guide 82 includes an annular end surface 92. The seal guide 82, the stator housing 74, and the bottom sub 54 can therefore be substantially non-rotatably coupled to one another such that when the flats 70 of the bottom sub 54 are engaged by the drilling machine 10, the stator housing 74 and the seal guide 82 are also substantially rotatably fixed.

In addition, the telescoping sub 50 includes a rotor shaft 94 (FIG. 7) having a central axis 96. The rotor shaft 94 is generally tubular and includes a first end 98 engageable with the rotary head 36, and a second end 102 that is received by the stator housing 74 and the seal guide 82. The first end 98 defines a tapered externally threaded projection 106 that is engageable with the internally threaded bore 42 of the rotatable portion 40. The first end 98 also includes flats 110 that are configured similarly to the flats 70 of the bottom sub 54, and are similarly engageable by the drilling machine 10 to rotatably fix the rotor shaft 94.

The second end 102 has a reduced diameter with respect to the first end 98 and is configured to be at least partially received by the seal guide 82 and the stator housing 74. The second end 102 includes an annular end surface 114 having formed therein a plurality of angularly spaced apart and axially inwardly extending threaded bores 118. The threaded bores 118 are substantially equally spaced along a bolt circle, and an axially extending annular projection 122 extends away from the annular end surface 114 and is radially inwardly spaced with respect to the threaded bores 118. A channel 126 extends through the rotor shaft 94 from the annular projection 122 to the externally threaded projection 106.

A bushing 130 (FIG. 8) includes an external diameter that is enlarged with respect to the bottom sub 54 and the rotor shaft 94. The bushing 130 surrounds the second end 102 of the rotor shaft 94 and is engageable with the annular end surface 92 of the seal guide 82. The bushing 130 is slideable and rotatable with respect to the rotor shaft 94. The outer surface of the bushing 130 is engageable by the drilling machine to support the telescoping sub 50 during drilling operations.

Referring also to FIGS. 9-13, a rotor dog 134 (FIG. 11) is coupled to the rotor shaft 94 and is selectively drivingly engageable with lock plates 138 (FIG. 12) that are coupled to the stator housing 74 (e.g. by welding or adhesives, for example). The rotor dog 134 is generally cylindrical and includes a plurality (e.g. three as illustrated) of angularly spaced apart, radially extending drive dogs 142. Each drive dog 142 defines a pair of detent recesses 144 formed in the end surfaces of the rotor dog 134. The rotor dog 134 also includes a central bore 146, and a plurality of angularly spaced apart apertures 150 that are substantially equally spaced along a bolt circle that surrounds the central bore 146. The rotor dog 134 is mateable with the annular end surface 114 of the rotor shaft 94, and the apertures 150 are each alignable with one of the threaded bores 118 such that fasteners 154 can be extended through the apertures 150 and into the threaded bores 118 to secure the rotor dog 134 to the rotor shaft 94. The central bore 146 is configured to receive tile annular projection 122.

Each lock plate 138 includes an arcuate cross section (see FIGS. 12*c* and 12*d*) and is received within the annular space between the second end 102 of the rotor shaft 94 and the stator housing 74. One end of each lock plate 138 includes a lower engagement tab 158, and an opposite end of each lock plate 138 includes an upper engagement tab 162. The end surfaces of the lower engagement tab 158 and the upper engagement tab 162 each include an axially extending blind bore 164. The lock plates 138 are substantially equiangularly spaced from each other such that each drive dog 142 of the rotor dog 134 is engageable one of the lock plates 138 when the rotor shaft 94 is rotated. Engagement between the drive dogs 142 and the lock plates 138 transmits rotational motion provided by the rotary head 36 from the rotor shaft 94 to the bottom sub 54.

Figure 13A:
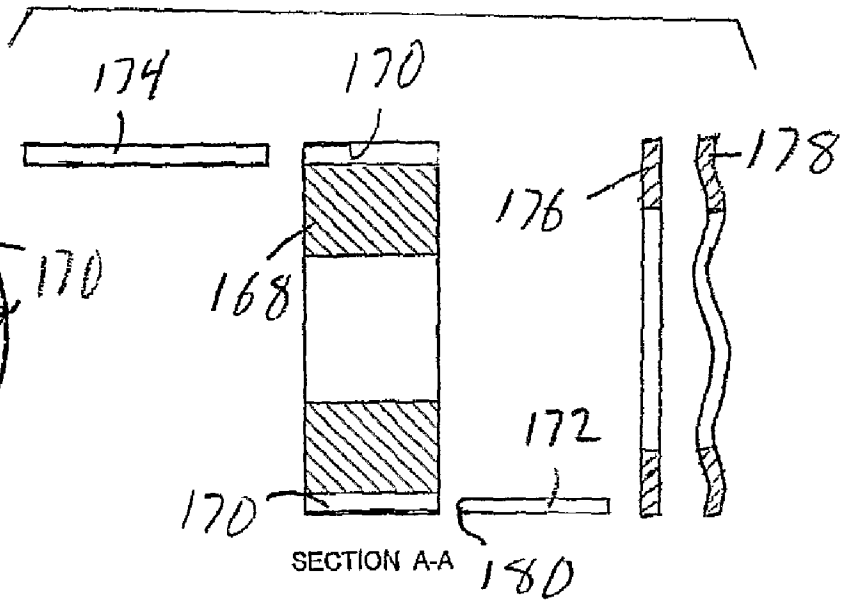
FIG. 13*a* is an exploded view illustrating a detent assembly of the telescoping sub shown in FIG. 3.
Figure 13B:
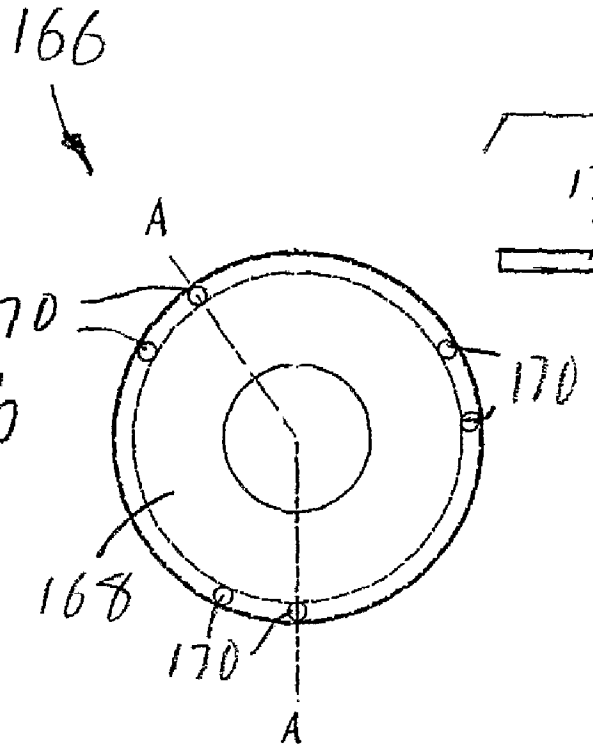
FIG. 13*b* is an end view of the detent housing shown in FIG. 13*a*.
Figure 13C:
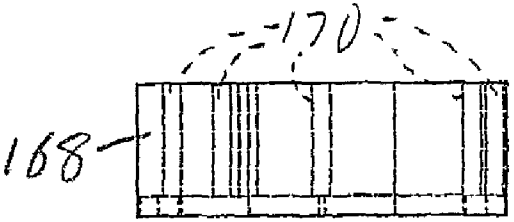
FIG. 13*c* is a side view of the detent housing shown in FIG. 13*a*.
Figure 14:
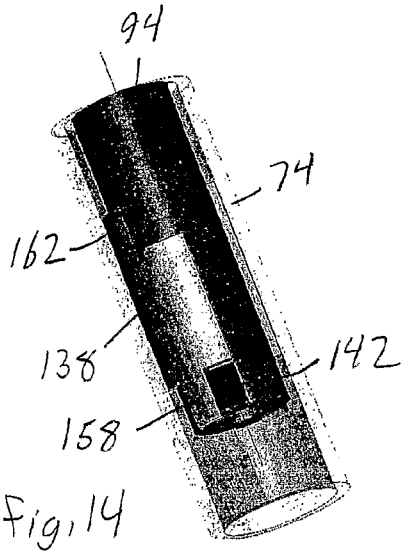
FIG. 14 is a perspective view with portions in phantom of the telescoping sub shown in FIG. 3 in a retracted and engaged position.
Figure 15:
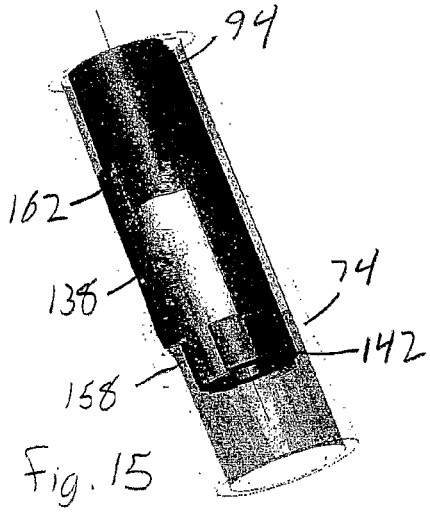
FIG. 15 is a perspective view with portions in phantom of the telescoping sub shown in FIG. 3 in a retracted and disengaged position.
Figure 16:
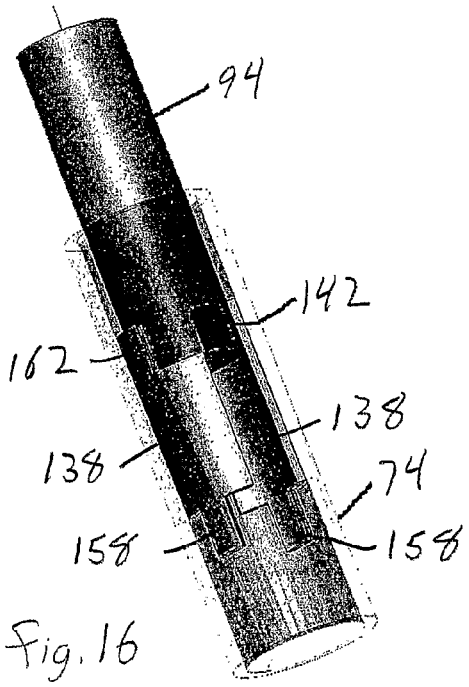
FIG. 16 is a perspective view with portions in phantom of the telescoping sub shown in FIG. 3 in an extended and disengaged position.

The telescoping sub 50 includes a pair of detent couplings 166 (FIG. 13) that engage the end surfaces of the upper and lower engagement tabs 162, 158. Each detent coupling 166 includes a generally annular detent housing 168 that defines a plurality (e.g. six as illustrated) of axially extending through holes 170. The through holes 170 are radially spaced from one another and positioned adjacent the outer circumference of the detent housing 168. Each detent coupling 166 also includes three detent pins 172 and three locking pins 174 (only one of each pin is shown in FIG. 13). Each detent coupling further includes a flat washer 176 that is biased toward the detent housing 168 by a wave spring washer 178. The flat washer 176 engages the ends of the detent pins 172 and the locking pins 174.

The locking pins 174 have a length that is longer than the detent housing 168 such that when the telescoping sub 50 is assembled, the locking pins 174 extend through the holes 170 of the detent housing 168 and into the blind bores 164 of the upper or lower engagement tabs 162, 158. The locking pins 174 non-rotatably fix the detent couplings 166 to the lock plates 138 and the stator housing 74. The detent pins 172 include rounded ends 180 and are biased by the wave spring washer 178 such that the rounded ends 180 selectively extend into the detent recesses 144 defined by the drive dogs 142, thereby providing detent engagement between the detent couplings 166 and the rotor dog 134 during rotation of the rotor shaft 94 with respect to the stator housing 74.

Figure 17:
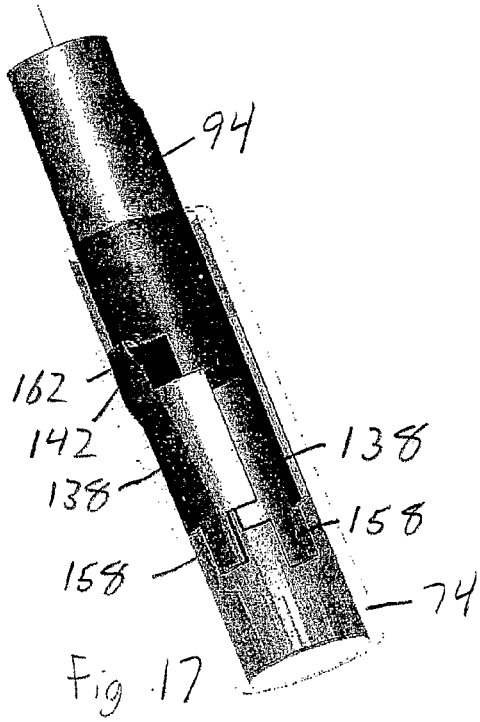
FIG. 17 is a perspective view with portions in phantom of the telescoping sub shown in FIG. 3 in an extended and engaged position.

Referring also to FIGS. 14-17, the telescoping sub 50 is adjustable between a retracted position (FIG. 14) and an extended position (FIG. 17). In the retracted position, the drive dogs 142 of the rotor dog 134 are engaged with the lower engagement tabs 158 of the lock plates 138. In the extended position, the drive dogs 142 are engaged with the upper engagement tabs 162. The detent couplings 166 provide detent engagement in both the extended and retracted positions.

As mentioned above, a conventional drill rod can be coupled to the telescoping sub 50, thereby forming a drill rod assembly. The length of the drill rod is preferably selected such that the combined length of the drill rod, any additional subs, and the telescoping sub 50 in the retracted position substantially corresponds to the distance traveled by the rotary head 36 in moving between the raised and lowered positions. With the sub 50 in the retracted position, the rotary head 36 is operated to rotate the telescoping sub 50 in a first (e.g. clockwise) direction, and the feed cable system 44 is operated to urge the rotary head 36 downwardly, thereby drilling a hole in the ground 16. The drilling operation continues until the flats 70 on the bottom sub 54 are substantially aligned with the clamping mechanism on the deck 17. Rotation and downward movement of the rotary head 36 is halted and the clamping mechanism engages the flats 70 such that the bottom sub 54 is held substantially fixed. The rotary head 36 is then operated to rotate the rotor shaft 94 in a second, opposite direction (e.g. counter-clockwise) to overcome the detent coupling 166 and to disengage the drive dogs 142 from the lower engagement tabs 158 (see FIG. 15). The feed cable system 44 is then operated to move the rotary head 36 upwardly along the tower 22 such that the rotor shaft 94 is moved toward the extended position, in which the drive dogs 142 are substantially aligned with the upper engagement tabs 162 (see FIG. 16). The rotary head 36 is again operated to rotate the rotor shaft 94 in the first direction such that the drive dogs 142 engage the upper engagement tabs 162 and the detent pins 172 engage the detent recesses 144. The drilling operation is then resumed, with the rotary head 36 operating to rotate the drill rod assembly, and the feed cable system 44 urging the drill rod assembly downwardly to continue drilling the hole.

When the hole has been drilled to the desired depth, the rotary head 36 and feed cable system 44 are operated to withdraw the telescoping sub 50 from the hole. When the flats 70 of the bottom sub 54 are aligned with the deck 17, the clamping mechanism engages the bottom sub 54 and the rotary head 36 and feed cable system 44 are operated to return the sub 50 to the retracted position. The remaining length of the drill rod assembly is then withdrawn from the hole in the conventional manner.

Figures 18, 19, 20A, 20B:
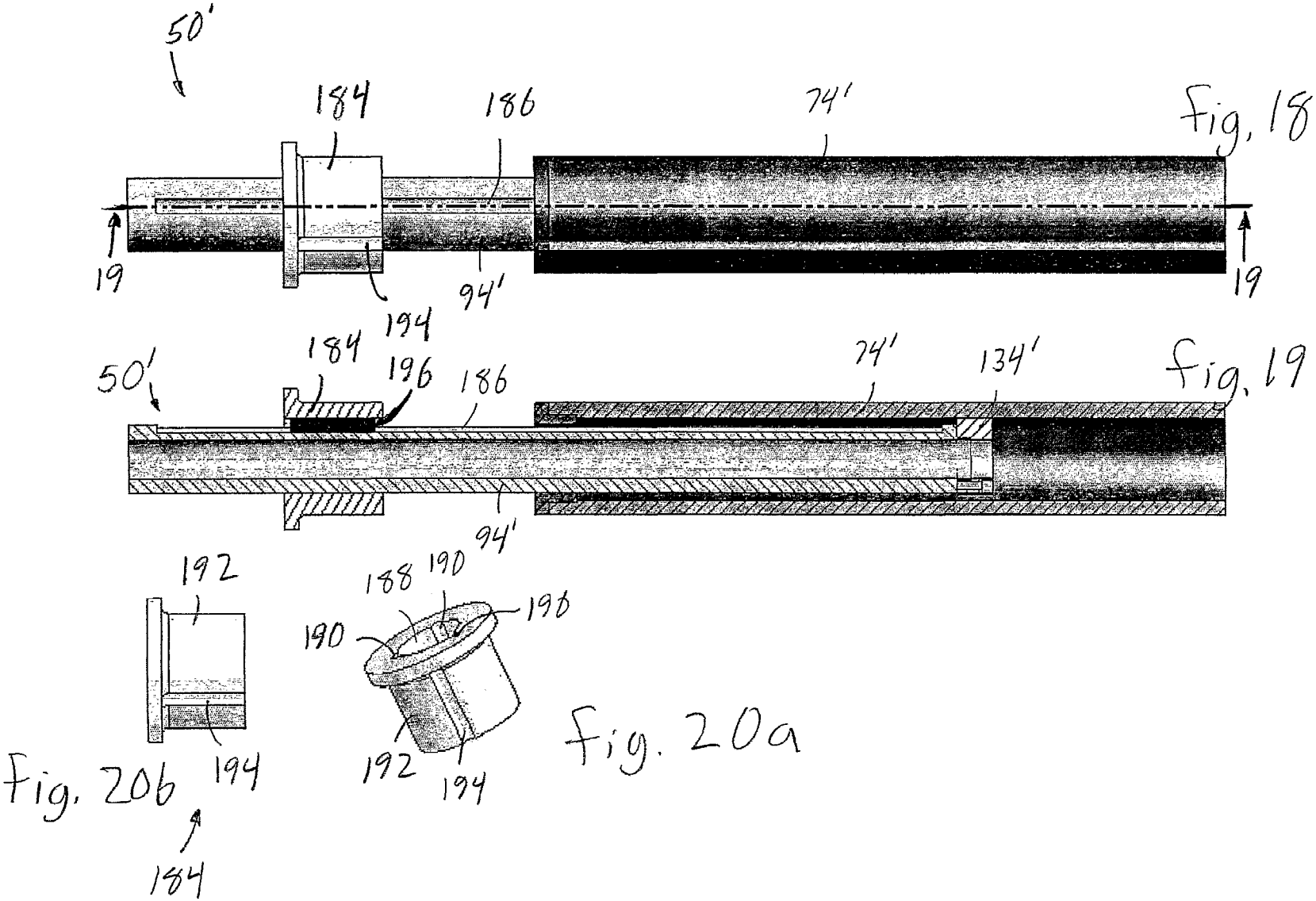
FIG. 18 is a side view of a telescoping sub configured for use with a kelly drive embodying an alternative embodiment of the invention.
FIG. 19 is a section view taken along line 19-19 of FIG. 18.
FIG. 20*a* is a perspective view illustrating a kelly bushing of the telescoping sub shown in FIG. 18.
FIG. 20*b* is a side view of the kelly bushing shown in FIG. 20*a*.

FIGS. 18 and 19 illustrate an alternative embodiment of the telescoping sub 50' that is also moveable between a retracted position and an extended position. The telescoping sub 50' is configured for use with a drilling rig (not shown) having a kelly drive system. A kelly drive system is distinguished from the rotary head 36 and feed cable system 44 discussed above in that a kelly drive system provides rotational motion to the telescoping sub 50' through a rotary table (not shown) that is fixed to the deck 17 of the drilling rig. A kelly bushing 184 (FIG. 20) is therefore provided and is axially slidable and rotatably fixed with respect to the telescoping sub 50'. The kelly bushing 184 is rotated by the rotary table during drilling operations.

More specifically, the telescoping sub 50' includes a stator housing 74' to which a bottom sub (similar to the bottom sub 54) can be coupled. The stator housing 74' receives a rotor shaft 94' having a plurality of axially extending grooves 186 defined along an outer surface thereof. Although not illustrated in FIGS. 18 and 19, the telescoping sub 50' also includes lock plates and detent couplings that are coupled to the stator housing 74' in a manner similar to that described above with respect to the telescoping sub 50. In addition, a rotor dog 134' is coupled to the end of the rotor shaft 94'.

The kelly bushing 184 is generally annular and includes an inner surface 188 that defines a plurality of axially extending output grooves 190, and an outer surface 192 that defines a plurality of axially extending input grooves 194. The kelly bushing 184 is configured to receive the rotor shaft 94' and a plurality of drive pins 196 (only one drive pin 196 is illustrated in FIG. 19) are inserted between the rotor shaft 94' and the kelly bushing 184. Each drive pin 196 is received by one of the grooves 186 in the rotor shaft 94' and one of the output grooves 190 in the kelly bushing 184 to non-rotatably couple the rotor shaft 94' and the kelly bushing 184 while still affording axial movement of the rotor shaft 94' with respect to the kelly bushing 184. The input grooves 194 of the kelly bushing 184 are engageable by the rotary table to rotate the kelly bushing 184 and the rotor shaft 94'. While the illustrated telescoping sub 50' utilizes drive pins and grooves defined by the kelly bushing 184 and the rotor shaft 94' for the transfer of rotational motion, substantially any type of non-rotatable coupling that also affords relative axial movement (e.g. non-circular cross sections, and the like) can also be used.

Operation of the telescoping sub 50' and movement of the telescoping sub 50' between the retracted and the extended positions is substantially the same as that described above with respect to the telescoping sub 50. With the telescoping sub 50' in the retracted position, the rotary table is operated to rotate the telescoping sub 50' and the drill rod assembly, while a feed system (which may or may not be similar to the feed cable system 44) urges the drill rod assembly downwardly to drill the hole. When a first depth is reached, the rotary table and feed system are operated to move the telescoping sub 50' to the extended position and the drilling operation is then resumed until the hole is drilled to the desired or maximum depth.

The invention claimed is:

1. A telescoping sub assembly adapted to be coupled between a drill head of a drilling rig and a drill rod, the telescoping sub assembly comprising:

a stator portion coupled to the drill rod and defining a drilling axis;

a rotor portion coupled to the drill head and moveable with respect to the stator portion between a retracted position corresponding to a first drilling depth, and an extended position corresponding to a second drilling depth; and a locking assembly selectively engaged by at least one of the stator portion and the rotor portion to prohibit relative rotation of the rotor portion with respect to the stator portion when the rotor portion is in the retracted and extended positions.

2. The telescoping sub assembly of claim 1, further comprising a detent assembly including a first portion coupled to the stator portion and a second portion coupled to the rotor portion, the first and second portions engaging one another when the rotor portion is in the retracted and the extended positions.

3. The telescoping sub assembly of claim 2, wherein the first portion includes a pair of axially spaced detent couplings coupled to the stator portion, and the second portion includes a drive dog coupled to the rotor portion, and wherein when the rotor portion is in the retracted position the drive dog detently engages one of the detent couplings, and when the rotor portion is in the extended position, the drive dog detently engages the other of the detent couplings.

4. The telescoping sub assembly of claim 3, wherein each detent coupling defines a plurality of bores, and each bore receives an axially biased detent pin including an end extending axially beyond the detent coupling, and wherein the drive dog defines a plurality of detent recesses that receive the detent pins when the rotor portion is in the extended and retracted positions.

5. The telescoping sub assembly of claim 1, wherein the locking assembly includes a locking plate coupled to the stator and providing a first engagement portion and a second engagement portion axially spaced from the first engagement portion.

6. The telescoping sub assembly of claim 5, wherein the locking assembly includes a drive dog coupled to the rotor portion, the drive dog engaging the first engagement portion when the rotor portion is in the retracted position, and engaging the second engagement portion when the rotor portion is in the extended position, and wherein engagement between the drive dog and the first and second engagement portions transmits rotation from the rotor portion to the stator portion.

7. The telescoping sub assembly of claim 5, wherein the stator portion receives at least a portion of the rotor portion, and wherein the locking plate is received within an annular space defined between the stator portion and the rotor portion.

8. A telescoping sub assembly adapted to be coupled between a drill head of a drilling rig and a drill rod, the telescoping sub assembly comprising:

a generally cylindrical stator housing defining a drilling axis;

a bottom sub coupled to an end of the stator housing and adapted to be coupled to the drill rod;

a generally cylindrical guide member coupled to an opposite end of the stator housing;

a rotor shaft having a first end adapted to be coupled to the drill head, and a second end that is received by the guide member and the stator housing, the rotor shaft moveable with respect to the guide member between a retracted position corresponding to a first drilling depth and an extended position corresponding to a second drilling depth;

a locking plate coupled to the stator housing and providing a first engagement portion adjacent the bottom sub and a second engagement portion adjacent the guide member; and a drive dog coupled to the second end of the rotor shaft, the drive dog engaging the first engagement portion when the rotor portion is in the retracted position and engaging the second engagement portion when the rotor portion is in the extended position, engagement between the drive dog and the first and second engagement portions transmitting rotational movement from the rotor shaft to the stator housing.

9. The telescoping sub assembly of claim 8, further comprising a first detent assembly coupled to the stator housing adjacent the bottom sub, and a second detent assembly coupled to the stator housing adjacent the guide member, the first detent assembly detently engaging the drive dog when the rotor shaft is in the retracted position, and the second detent assembly detently engaging the drive dog when the rotor shaft is in the extended position.

10. The telescoping sub assembly of claim 9, wherein the detent assemblies each include a biasing member and a detent member, and the drive dog defines a detent recess, wherein when the rotor shaft is in the retracted position the detent member of the first detent assembly is biased into engagement with the detent recess, and wherein when the rotor shaft is in the extended position the detent member of the second detent assembly is biased into engagement with the detent recess.

11. A method for drilling a hole in the ground with a drilling rig, the drilling rig including a tower and a drill head that is moveable along the tower, the method comprising:

providing a telescoping sub assembly that is adjustable between a retracted configuration and an extended configuration;

coupling one end of the telescoping sub to the drill head;

coupling an opposite end of the telescoping sub to a drill rod, thereby defining a drill string;

operating the drilling rig to drill to a first depth;

upon reaching the first depth, operating the drilling rig to adjust the telescoping sub assembly from the retracted configuration to the extended configuration, including rotating the rotor portion with respect to the stator portion to disengage the rotor portion from the stator portion; and with the telescoping sub assembly in the extended configuration, operating the drilling rig to drill to a second depth that is greater than the first depth.

12. The method of claim 11, wherein operating the drilling rig to drill to a first depth includes rotating the drill string in a drilling direction, and moving the drill head along the tower to urge the drill string into the ground.

13. The method of claim 12, wherein rotating the drill string includes rotating the drill head.

14. The method of claim 12, wherein rotating the drill string includes rotating a kelly bushing that is rotatably fixed and axially moveable with respect to the drill string.

15. The method of claim 11, wherein coupling an opposite end of the telescoping sub to the drill rod includes coupling a stator portion of the telescoping sub to the drill rod.

16. The method of claim 15, wherein coupling one end of the telescoping sub to the drill head includes coupling a rotor portion of the telescoping sub to the drill head.

17. The method of claim 16, wherein operating the drilling rig to adjust the telescoping sub assembly from the retracted configuration to the extended configuration comprises:

rotatably fixing the stator portion;

rotating the rotor portion in a first direction with respect to the stator portion, thereby rotatably disengaging the rotor portion from the stator portion;

moving the rotor portion axially with respect to the stator portion from the retracted configuration to the extended configuration; and rotating the rotor portion in a second direction with respect to the stator portion, thereby rotatably engaging the rotor portion and the stator portion.

18. The method of claim 17, wherein rotatably disengaging the rotor portion from the stator portion includes overcoming a detent assembly and disengaging a drive dog from an engagement tab.

19. The method of claim 17, wherein rotatably engaging the rotor portion and the stator portion includes overcoming a detent assembly and engaging a drive dog with an engagement tab.

* * * * *